US008469007B2

(12) United States Patent
Tokuo et al.

(10) Patent No.: US 8,469,007 B2
(45) Date of Patent: Jun. 25, 2013

(54) CONTROLLING APPARATUS OF VARIABLE CAPACITY TYPE FUEL PUMP AND FUEL SUPPLY SYSTEM

(75) Inventors: Kenichiro Tokuo, Hitachinaka (JP); Satoshi Usui, Hitachinaka (JP); Hiroyuki Yamada, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 12/478,983

(22) Filed: Jun. 5, 2009

(65) Prior Publication Data

US 2009/0241908 A1 Oct. 1, 2009

Related U.S. Application Data

(63) Continuation of application No. 11/217,444, filed on Sep. 2, 2005, now Pat. No. 7,559,313.

(30) Foreign Application Priority Data

Dec. 7, 2004 (JP) ..... 2004-353491

(51) Int. Cl.
*F02M 37/04* (2006.01)

(52) U.S. Cl.
USPC ..... 123/501; 123/459; 123/495

(58) Field of Classification Search
USPC ..... 123/446, 456, 458, 500, 501, 502, 123/506
See application file for complete search history.

(56) References Cited

U.S. PATENT DOCUMENTS

| | | | | |
|---|---|---|---|---|
| 3,942,494 | A * | 3/1976 | Toda et al. | 123/445 |
| 4,831,988 | A * | 5/1989 | Hoefken et al. | 123/501 |
| 4,940,034 | A | 7/1990 | Heim et al. | |
| 6,314,945 | B1 | 11/2001 | Sugiyama et al. | |
| 6,336,445 | B1 * | 1/2002 | Yamazaki et al. | 123/506 |
| 6,546,917 | B2 | 4/2003 | Onishi et al. | |
| 6,823,834 | B2 | 11/2004 | Benson et al. | |

FOREIGN PATENT DOCUMENTS

| | | |
|---|---|---|
| EP | 1 101 930 A1 | 5/2001 |
| JP | 2001-041088 | 2/2001 |

* cited by examiner

*Primary Examiner* — Mahmoud Gimie
*Assistant Examiner* — David Hamaoui
(74) *Attorney, Agent, or Firm* — Crowell & Moring LLP

(57) ABSTRACT

A controlling apparatus of a variable capacity type fuel pump, for avoiding noises caused due to drive of the fuel pump and noises caused due to drive of injectors from overlapping or duplicating with each other in the timing thereof, wherein signals for driving the pump reduced, or the timing thereof is shifted forward/backward, within a specific timing where the o overlapping can be prospected, or a specific timing where they are determined to overlap or duplicate with each other.

5 Claims, 9 Drawing Sheets

CONTROLLING APPARATUS OF VARIABLE CAPACITY TYPE FUEL PUMP AND FUEL SUPPLY SYSTEM

CROSS REFERENCE TO RELATED APPLICATION

This application is a continuing application of U.S. application Ser. No. 11/217,444, filed Sep. 2, 2005, which claims priority under 35 U.S.C. §119 to Japanese Patent Application No. 2004-353491, filed Dec. 7, 2004, the entire disclosure of which are herein expressly incorporated by reference.

BACKGROUND OF THE INVENTION

The present invention relates to a controlling apparatus of a high-pressure fuel pump for an internal combustion engine, and in particular, it relates to a controlling method of a high-pressure fuel pump for reducing noises within the internal combustion engine.

Conventionally, a controlling apparatus for a fuel pump is already known, for example, in the following Patent Document 1, which comprises a high-pressure fuel pump, for sucking fuel into a pressurizing chamber by changing the volume thereof upon basis of a relative movement of a cylinder and a plunger due to rotation of a cam, thereby sending the fuel sucked towards a fuel injection valve of an internal combustion engine under pressure, and a spill valve for opening/closing a fuel passage, which is provided between a spill passage for flowing out the fuel from the pressurizing chamber, and the pressuring chamber, whereby controlling a period when the spill valve is opened, so as to regulate or adjust an amount of fuel, which is transferred from the high-pressure fuel pump into the fuel injection valve under pressure. In this apparatus, an amount of fuel, which is transferred under pressure per one (1) cycle or stroke thereof, is decreased or reduced by reducing the number of times of fuel injections of the fuel injection valve per one (1) cycle of the transfer of fuel under pressure, when the internal combustion engine operates under the condition of a low load. With this, it is possible to shift a starting period for closing the spill valve up to the top dead center of the cam, i.e., bringing the cam speed to be small when the spill valve is closed, and thereby reducing a sound, which is generated upon closure of the spill valve. And, it is possible to suppress the operating sound of the spill valve from coming up to be relatively large, during the time of an idling operation when operating sounds of the internal combustion engine itself come down to be small, such as, a combustion sound, etc., for example.

Patent Document 1: Japanese Patent Laying-Open No. 2001-41088 (2001).

Thus, with such the conventional art as was mentioned above, since no consideration is paid upon a correlation between the equipments, which constitute the engine, other than the high-pressure fuel pump, therefore no attention is paid on an aspect that the noises are duplicated or overlapped by the equipments themselves, which constitute the engine, i.e., the noises are increased through a synergistic effect thereof.

The noises generated from the engine include, not only the noises caused by the high-pressure fuel pump, but also the noises caused by the injector (i.e., the fuel injection valve) and/or a moving valve, or due to the combustion, etc., for example. Those noises, although being not so large by itself, but sometimes could be felt to be noisy, in particular, due to the synergistic effect, when they are generated overlapping or duplicating with each other in the timing thereof. For example, the injector and the high-pressure fuel pump sometimes generate the noises (i.e., the operation sounds) accompanying with the drives thereof, respectively, and if they are overlapped with each other, they are sometimes felt to be a noise, in particular, being large for the sense of hearing of a human being.

For the injector, the drive timing of which is closely related to the operation condition of the engine, it is not easy to change the drive timing, arbitrarily. Also, with the high-pressure fuel pump (for example, a fuel pump of a variable capacity type), having the structure of controlling the discharge flow amount by changing the drive timing thereof, it is impossible to keep a common rail pressure at a desired pressure, since the discharge flow amount is changed when the drive timing thereof is altered.

BRIEF SUMMARY OF THE INVENTION

According to the present invention, an object thereof is to avoid the synchronization between the noise, which is caused due to driving of the high-pressure fuel pump, and the noise, which is caused due to operation of the injector, while keeping the engine under a desired operating condition.

For achieving the object mentioned above, according to the present invention, for the purpose of maintaining a predetermined time-interval between the drive timing of an injector and the drive timing of a variable capacity controlling mechanism, which is provided within a variable capacity type fuel pump, so as to eliminate the duplication or overlapping on the drive timings thereof, control of the driving timing of the variable capacity controlling mechanism is effected.

According to the present invention, it is possible to avoid the synchronization of noises (i.e., operating sounds) of the injector and the variable capacity type fuel pump, while keeping the engine under the desired operating condition with maintaining the drive timing of the injector.

BRIEF DESCRIPTION OF THE SEVERAL VIEWS OF THE DRAWING

Those and other objects, features and advantages of the present invention will become more readily apparent from the following detailed description when taken in conjunction with the accompanying drawings wherein.

DETAILED DESCRIPTION OF THE INVENTION

Figure 1:
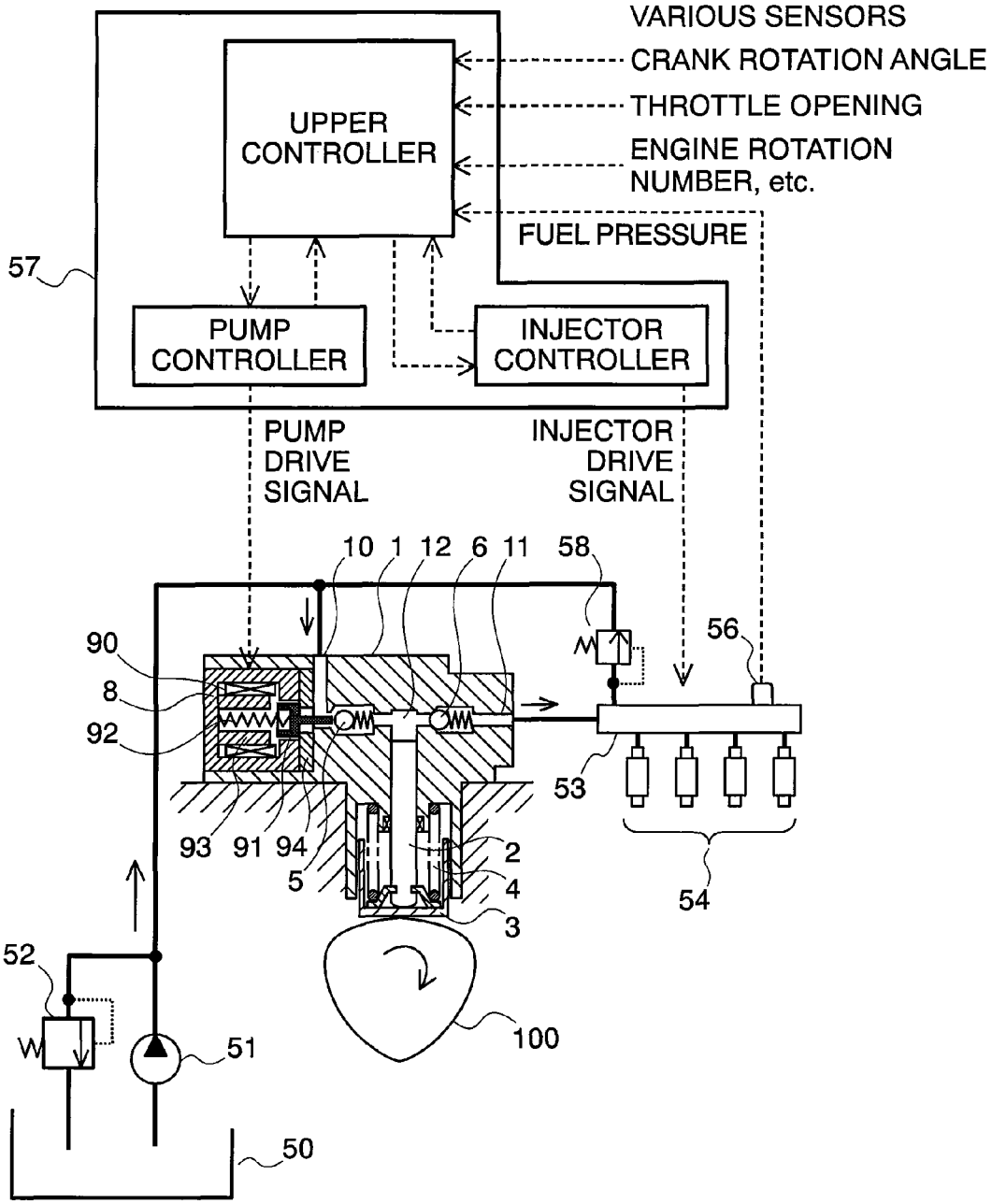
FIG. 1 shows an entire structure view of a fuel supply system for an internal combustion engine, according to an embodiment of the present invention.

According to an embodiment of the present invention, in order to keep a predetermined time-interval between the drive timing of the injector and the drive timing of the variable capacity controlling mechanism, which is provided within the variable capacity type fuel pump, so as to eliminate the duplication or overlapping in the drive timings thereof, control is made on the driving timing of the variable capacity control mechanism. By doing this, it is possible to avoid the synchronization of noises (i.e., the operating sounds) of the injector and the variable capacity type fuel pump. However, the variable capacity controlling mechanism is a mechanism for controlling a discharge flow amount from the pressurizing chamber, through regulation or adjustment of the fuel to be turned from a pressurizing chamber of the variable capacity type fuel pump back to a side of a low pressure passage, by controlling the drive timing thereof.

More specifically, by reducing the number of times the variable capacity type fuel pump is driven, the predetermined time-interval is maintained between the drive timing of the injector and the drive timing of the variable capacity type fuel pump. For that purpose, when it is impossible to maintain the predetermined time-interval between the driving timing of the injector, it is preferable to cause the variable capacity type fuel pump to be non-driven. Or, it is preferable to cause the variable capacity type fuel pump to be non-driven when the drive timing of the variable capacity type fuel pump lies within a possible time-interval, during which it may overlap or duplicate the drive timing of the injector in the timing thereof.

The driving of the variable capacity type fuel pump corresponds to the discharge of fuel to a high-pressure side (i.e., a common rail side), and also to the driving (or, controlling) of the variable capacity control mechanism so that the fuel is discharged into the high-pressure side (i.e., the common rail side). Also, causing the variable capacity type fuel pump to be non-driven in the operating condition thereof corresponds to stopping the discharge of fuel to be supplied from the variable capacity type fuel pump to the high-pressure side (i.e., the common rail side).

Or alternatively, for maintaining the predetermined time-interval between the drive timing of the injector and the drive timing of the variable capacity type fuel pump, the drive timing of the variable capacity type fuel pump is changed so that the predetermined time-interval can be maintained therein.

Further, upon driving of the variable capacity type fuel pump before and after the timing of non-driven or being changed, it is preferable to adjust the drive timing, so that a total flow amount, which is discharged from the variable capacity type fuel pump by one (1) cycle of an engine does not change. By doing this, it is possible to suppress change of the total flow amount discharging from the variable capacity type fuel pump during one (1) cycle of the engine.

Also, it is preferable to employ a feedback control upon the flow amount of the fuel being discharged from the variable capacity type fuel pump, so that the fuel pressure within the common rail is nearly constant on a time-averaged basis. By employing such feedback control, even if the pump drive is stopped or reduced, since the fuel pressure within the common rail is constant, it is possible to maintain or even increase the flow amount of fuel automatically, discharging from the variable capacity type fuel pump during one cycle or stroke thereof; therefore, it is possible to maintain the amount of fuel being discharged from the variable capacity type fuel pump constant within a predetermined time period.

Also, it is preferable to apply such controlling method in an engine (i.e., an internal combustion engine), in particular, in an idling operation condition thereof. Under engine conditions where fuel consumption is lower, such as, when it is idling, since the reduction of pressure is small within the common rail due to fuel injections, therefore, it is possible to apply the present controlling method therein under the condition that pressure pulsation of the common rail is lower.

Also, it is preferable to achieve the feedback control upon the flow amount discharging from the variable capacity type fuel pump, so as to bring the fuel pressure within the common rail to be nearly constant on an average of one (1) cycle of the engine, by increasing the flow amount discharging from the variable capacity type fuel pump one (1) cycle thereof, as well as, reducing the number of times needed for driving for the variable capacity type fuel pump. By doing this, even though the frequency is reduced on discharging from the variable capacity type fuel pump, it is possible to maintain the fuel supply in the amount thereof, during one (1) cycle of the engine.

Also, it is preferable to reduce the drives of the variable capacity type fuel pump, at a specific timing thereof. If the timing at which the noises overlap or duplication occurs can be determined in advance, it is possible to specify a driving signal to be thinned out, but without need for an overlap determining mechanism; therefore, a controller can be simplified.

Also, it is preferable that, with provision of a timing determining circuit, for determining drive timing for the injector and the variable capacity type fuel pump, wherein if both timings are within a predetermined time band and it is determined that the noises overlap or duplicate each other, and at that timing the variable capacity type fuel pump is brought into the non-driven condition thereof. By doing this, the noises from overlapping or duplication thereof can be avoided.

Also, as a way of bringing the variable capacity type fuel pump into the non-driven condition, it is preferable that a controlling apparatus gives no drive signal, or that a drive signal is given thereto, which has such a length that the variable capacity type fuel pump cannot operate fully. Thus, the drive signal width (i.e., time) is shortened, compared to the response time of the variable capacity type fuel pump, so that the drive signal is distinguished before starting of drive of the variable capacity type fuel pump.

Also, it is preferable to shift the timing of applying the drive signal to the variable capacity type fuel pump, forward and backward periodically. By doing this, though a flow amount discharged from the variable capacity type fuel pump increases or decreases, periodically, it is possible to change the drive timing of the variable capacity type fuel pump while maintaining the total amount of discharging flow within the predetermined time; i.e., it is possible to avoid the noises from overlapping or duplicating each other.

Embodiment 1

Hereinafter, explanation will be given about an embodiment of the present invention.

First of all, explanation will be made on the structures of a fuel supply system, which applies the variable capacity type fuel pump according to the present embodiment therein, by referring to FIG. 1. In a pump main body 1 are formed a fuel suction passage 10, a discharge passage 11, and a pressurizing chamber 12. Within the pressurizing chamber 12, a plunger 2 is slidably held and functions as a pressurizing member. In the suction passage 10 and the discharge passage 11 are provided a suction valve 5 and a discharge valve 6, respectively. The suction valve 5 and the discharge valve 6 are biased by springs in one direction, so that they act as a check valve. Also, to the suction passage 10 is connected a low-pressure valve 9.

A variable capacity control mechanism 8 is held within the pump main body 1, and is comprised of a solenoid coil 90, a rod 91, and a spring 92. The rod 91 is biased by spring 92 into a direction for opening the suction valve 5 when no drive signal is applied to the variable capacity control mechanism 8. The biasing force of the spring 92 is sized to be larger than that of the spring for the suction valve 5; therefore, when no drive signal is applied to the variable capacity control mechanism 8, as is shown in FIG. 1, the suction valve 5 is in the condition of being closed.

Fuel is guided from a tank 50 to the fuel suction passage 10 of the pump main body 1 through a low-pressure pump 51, being maintained at a constant pressure via a pressure regulator 52. Thereafter, the fuel is pressurized within the pump main body 1, to be transferred or supplied from the discharge passage 11 to the common rail 53 under pressure. Onto the common rail 53 are attached injectors 54, a pressure sensor 56 and a safety valve 58. The safety valve 58 opens the valve when the fuel pressure within the common rail 53 goes over a predetermined value, i.e., protecting the high-pressure pipe arrangement system.

The injectors 54 are mounted onto the engine, corresponding to the number of cylinders thereof, and each of which injects the fuel in accordance with a signal from a controller 57. The pressure sensor 56 transmits the pressure data obtained to the controller 57.

The controller 57 calculates an appropriate injection fuel amount and/or a fuel pressure, etc., based upon the state quantities of the engine (for example, the crank rotation angle, the throttle opening, the engine rotation number, and the fuel pressure, etc.), which are obtainable from the various sensors, and timing and/or a flow rate for driving the pump 1 and the injectors 54, as well thereby, transmitting driving signals thereto. The controller 57 may also be constructed so that an upper controller for calculating instruction values is separated from a controller for directly transmitting the driving signals to the pump and the injectors, or alternatively may be constructed into a unit combining them into one body.

The plunger 2 performs reciprocal movement through a cam 100, which is rotated by an engine camshaft or the like, thereby changing the volume within the pressurizing chamber 12.

When the suction valve 5 is opened during the discharging process of the plunger 2, pressure within the pressurizing chamber 12 increases, and with this, the discharge valve 6 is opened automatically, so as to transfer the fuel to the common rail 53 under pressure.

The suction valve 5 is opened automatically when the pressure within the pressurizing chamber 12 becomes lower than that of a fuel induction pressure. Also, it is automatically closed when it is released from engagement with the variable capacity control mechanism 8 during the discharging process. The variable capacity control mechanism 8 generates a magnetic field by conducting current through a solenoid 90 when it is provided with the drive signal from the controller 57, thereby pulling the rod 91 which is biased by the spring 92. By doing this, the suction valve 5 disengages from the rod 91; therefore it thus acts as an automatic valve, effecting opening/closing thereof in synchronism with the reciprocal movement of the plunger 2. Accordingly, the suction passage 10 is blocked during the discharging process, and the fuel pushes the discharge valve 6 open; the fuel corresponding to reduction of the volume within the pressurizing chamber 12 is transferred to the common rail 53.

When no drive signal is provided to the variable capacity control mechanism 8, the rod 91 is in engagement with the suction valve 5 due to the biasing force of the spring 92; i.e., keeping the suction valve 5 in the opened condition thereof. Accordingly, since the pressure within the pressurizing chamber 12 is kept to be nearly equal to that of the fuel induction passage even when the discharging process occurs, then it is impossible to open the discharge valve 6, and the fuel corresponding to the reduction of volume within the pressurizing chamber 12 is turned back to a fuel induction side passing through the suction valve 5. Therefore, it is possible to bring the flow rate discharge from the pump to be zero.

Also, when the drive signal is provided to the variable capacity control mechanism 8, by way of the discharging process, then the rod 91 shifts its position, to be released from the engagement with the suction valve 5, so that it closes the valve 5; therefore, the fuel is transferred from the middle during the discharging process to the common rail 53 under pressure. Since the pressure is increased within the pressurizing chamber 12 when starting the transfer of fuel under pressure, the suction valve 5 keeps the blocking condition thereafter, even when the drive signal is cut off to the variable capacity control mechanism 8, so that the valve is automatically opened in synchronism with starting of the suction process. In this manner, adjusting the timing, when the drive signal is provided to the variable capacity control mechanism 8, enables the discharge amount to be regulated or adjusted variably within a range from zero (0) up to the maximum discharge amount.

Also, with provision of the drive signal to the variable capacity control mechanism 8 through calculation of appropriate discharge timing by the controller 57 based upon the signal from the pressure sensor 56, the pressure of the common rail 53 can be kept at a nearly constant value.

Next, explanation will be given about an example of driving the variable capacity control mechanism 8 of the high-pressure fuel pump, in accordance with the control method of the present invention, by referring to FIGS. 2 and 3.

Figure 2:
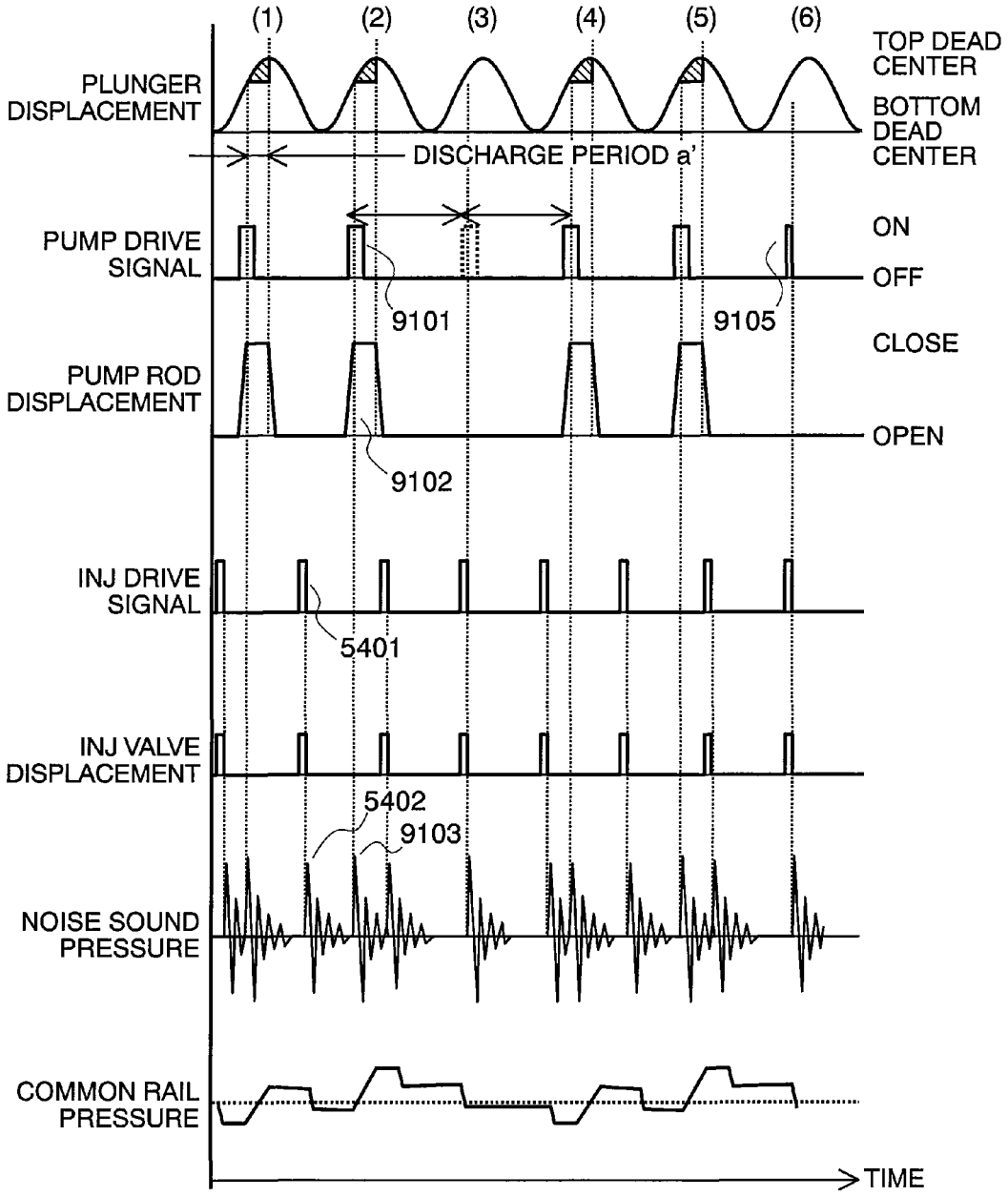
FIG. 2 shows an operation-timing chart of a fuel pump and an injector, shown in FIG. 1.

FIG. 2 shows a drive-timing chart within the fuel supply system mentioned above. "Plunger Displacement" at the uppermost stage indicates the operation of the plunger 2 shown in FIG. 1. A rising process indicates the pressurizing process, while a falling process indicates the suction process. The cam 100, driving the plunger 2 in FIG. 1, has three (3) edges (or projections), and therefore the plunger 2 makes three reciprocating movements per one (1) cycle or stroke of the camshaft 1. In FIG. 2, the plunger makes six reciprocating movements; i.e., showing a time range for two (2) revolutions of the camshaft (i.e., for two (2) cycles of the engine). "Pump Drive Signal" is provided at the timing calculated from the controller 57, and the rod 91 shifts the position as is shown by "Pump Rod Displacement". The rod 91 is engaged with the suction valve 5 under the non-conductive condition thereof, i.e., locating at the position "Open" of keeping the valve opened, while it is not engaged with the suction valve 5 under the conductive condition thereof, i.e., locating at the position "Close" of keeping the valve closed. When the rod 91 shifts the position into the close valve position at certain timing during the pressurizing process, the suction valve 5 is opened, and the pump starts the discharging operation; therefore, the pressure of the common rail increases. Thus, the fuel is discharged during the time of discharge period a' shown in FIG. 2. If the timing is early when the pump drive signal is provided, the discharged flow rate is more, and if it is late, the discharged flow rate is less. The controller 57 controls the timing when the pump drive signal is provided, depending upon the fuel supply amount necessary for the injectors 54.

The injectors 54 are provided, respectively, corresponding to the number of engine cylinders, and in the example shown in FIG. 1, there are provided four (4) pieces for a four (4)- cylinder engine. Those are driven one (1) time per one (1) cycle of the engine (=one (1) revolution of the camshaft); i.e., the controller 57 provides the drive signal to the injector, four (4) times in total, per one (1) cycle of the engine. "INJ Drive Signal" shows those injector drive signals. The controller calculates out the timing necessary for the fuel injection and a fuel amount necessary to be injected, and it regulates the timing and the length to be provided to them, respectively; i.e., controlling the injectors 54.

By the way, when the controller 57 turns the pump drive signal ON/OFF, then the rod 91 shifts the position thereof, and it abuts a stopper 93 or 94 at a terminal end of the stroke thereof; therefore, there is a possibility of generating vibrations and noises therefrom. This type of operating sound is a colliding sound. In a similar manner, operation of the injectors 54, when the drive signal is turned ON/OFF, also present is a possibility that vibrations and noises are generated. This type of operating sound is collision noise generated when the valve body collides on a valve seat and/or a stopper.

Vibration/noise generated when turning the signal ON/OFF is not always same in the magnitude thereof. For example, in relation to the pump, the rod 91 is operated with the electro-magnetic force when the signal is ON, while it is operated by the spring 92 when being OFF; therefore, there is a possibility that they are different from each other, in particular, in the magnitude of colliding energy thereof.

Also, in relation to the injector, the injection valve is operated to open through the electro-magnetic force when the signal is ON, while it is operated to close, by the spring force and the fuel pressure when being OFF; therefore, there is a possibility that that they are different from each other, in particular, in the magnitude of colliding energy thereof.

An aspect of the present embodiment resides in control so that the peak value of the pump noises and the peak value of the injector noises will not overlap each other. For example, in case when the vibrations/noises are large, being caused due to ON operation of the pump and the ON operation of the injector, it is necessary to control those timings so they do not overlap each other. Or, in case when the vibrations/noises are large, being caused due to OFF operation of the pump and the OFF operation of the injector, then it is necessary to control so that those timings do not overlap each other. According to the present embodiment, it is assumed that the vibrations/noises are large, being caused due to ON operation of the pump, and that vibrations/noises are large, being caused due to OFF operation of the injector, and a method will be described, for avoiding them from overlaying or synchronizing with each other.

At the second stage from the bottom in FIG. 2, the noise is shown in the form of the sound pressure waveform. For example, when a pump drive signal 9101 is provided, then the rod 91 shifts the position thereof, at the timing shown by rod displacement 9102. When the rod 91 collides on the stopper 93 at the "Close" position, the vibrations/noises (i.e., the colliding sound or operating sound) are generated; i.e., generating a pump drive noise 9103. Although the vibrations/noises (i.e., the colliding sound or operating sound) are also generated when the pump drive signal is turned OFF, it is assumed that they are not dominant ones as was mentioned above in the present embodiment; therefore, explanation will be made by paying attention only to the ON operation thereof. In relation to the injector, it is assumed that the noises (i.e., the colliding sound or operating sound), caused when OFF operation, are larger that those when ON operation; therefore, explanation will be made by paying attention to the OFF operation thereof. When an injector drive signal 5401 is provided, then the valve body of the injector shifts the position thereof, and therefore it generates an injector drive noise 5402. In FIG. 2, the injector drive noise 5402 is generated at the timing after OFF of the injector drive signal.

When the engine operates at a high speed (i.e., when operating at high-load), the plunger 2 of the pump makes reciprocating movements, at a rate 200 times/second or higher. For operating the rod 91 to respond to the high speed fitting such the reciprocating movements, it is necessary for the electro-magnetic force to be sufficiently large compared to the biasing force of the spring 92. For that reason, a large colliding force is generated, also when the engine operates at a low speed (i.e., when operating at low-load), such as, an idling operation or the like, the noises (i.e., the colliding sound or operating sound) are heard loud or large for the small engine sound, compared to that a large engine sound. However, when the engine operates at the low speed, such as, under the idling operation, the plunger 2 of the pump makes reciprocating movements at a degree of about 15 times/second. The cause of the noise generation is similar, in the relationship between the electro-magnetic force and the spring biasing force.

With the control method according to the present embodiment, the controller 57 thins or cut out the pump drive signal, one (1) for three (3), periodically. During the plunger cycles (1), (2), (4) and (5), where the drive signal is not cut out, the noises caused due to driving of the pump are generated, but do not overlap the noises due to driving of the injectors. On the other hand, during the plunger cycle (3) where the pump drive signal is cut out, of course, no operating sound is generated due to the displacement of the pump rod. For this reason, within this plunger cycle (3), no pump noise overlaps the injector noise. The position of the drive signal is indicated in FIG. 2 by a broken line, if the drive signal is not cut out in that cycle. If the pump is driven at the timing, there may be a possibility that the injector noise and the pump noise overlap or duplicate each other, thereby making the audible engine noises, especially loud or large. However, within the plunger cycle (6), the drive signal is narrowed in the width thereof, but in the place of thinning out the drive signal; thereby inhibiting the rod 91 from being operated. In this regard, explanation will be given later. Thus, in the present embodiment, it is characterized in that the cycle(s) is/are specified, in which the overlap or duplication would occur, in advance, so that the drive signal(s) for is/them are deleted. Further, the number of times of injections by the pump is reduced, and in addition thereof, the discharge flow rate by one (1) cycle of the pump is increased, thereby maintaining the total flow rate per one (1) cycle of the engine.

Figure 3:
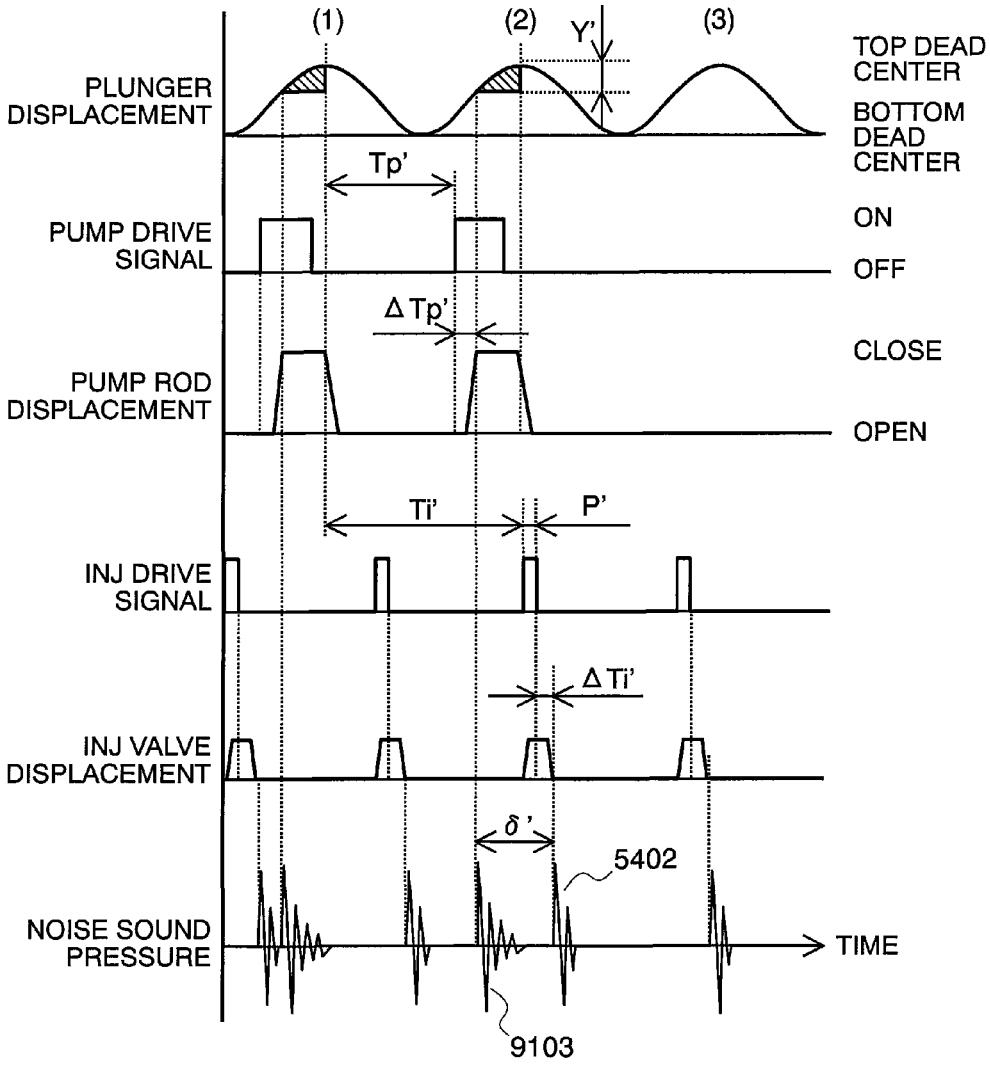
FIG. 3 shows the details of the timing chart shown in FIG. 2.

FIG. 3 shows an example of timing chart in case where the pump discharges an amount of fuel to be discharged not by three (3) cycles of, but by two (2) cycles thereof. For the purpose of comparison, FIG. 4 shows the timing chart where the pump discharges the amount by three (3) cycles thereof.

Figure 4:
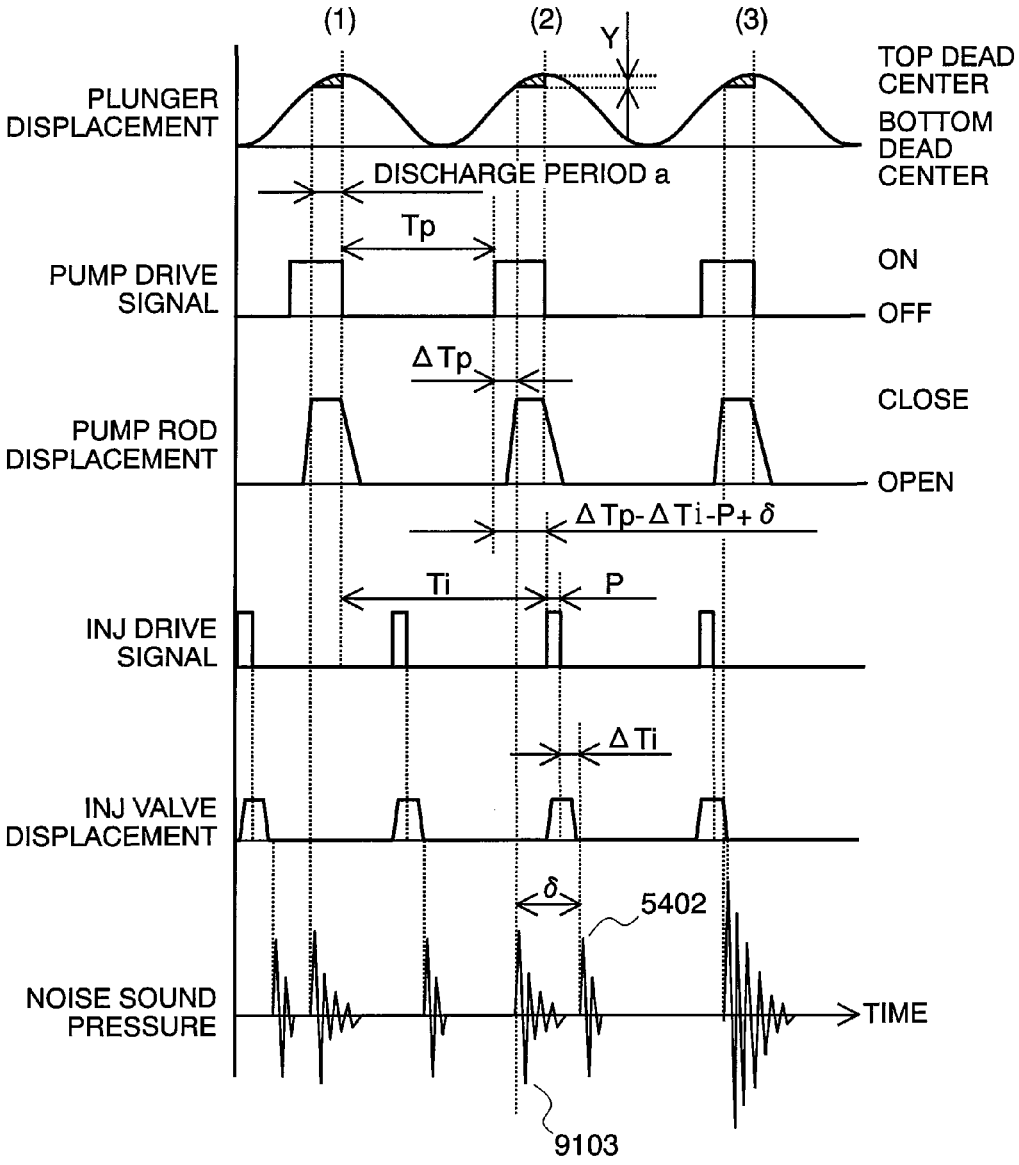
FIG. 4 shows a timing chart for explaining about overlapping of noises.

In FIG. 4, the pump drive signal is provided at a certain timing, which is calculated by the controller 57 (in this figure, after the time Tp from the top dead center of the cycle (1), for example). In FIG. 2, though the details thereof were omitted, there is a delay time ΔTp in response within a period after the time when the pump drive signal is provided up to the time when the pump rod shifts the position thereof. After the response delay time ΔTp, the rod 91 shifts position, so as to close the suction valve 5; therefore, the fuel is discharged, corresponding to the remaining stroke "Y" in the pressurizing process. In FIG. 4 it is indicated that the injector is driven by four (4) times or cycles while the fuel pump is driven by three (3) cycles, and that within the last one (1) cycle (i.e., within the plunger cycle (3)), the noise caused due to the injector driving and the noise caused due to the pump driving overlap or duplicate each other in the timing, thereby increasing the noise level thereof. If changing the pump drive signal within the plunger cycle (3) to the timing before or after thereof, so as to avoid the overlapping or duplication, then the flow rate discharged from the fuel pump is increased or decreased; therefore, it is impossible to maintain the pressure within the common rail at a desired value. As a control method for overcoming such the problem, there is a method for supplying the duel discharge equal to that shown in FIG. 4, by two (2) times of discharges thereof.

FIG. 3 shows the timing chart to which the method is applied. In this case, theoretically, the amount discharged by one (1) time or cycle of the pump comes to be 3/2=1.5 times larger, comparing to FIG. 4, and the timing of applying the pump dive signal is moved forward. The stroke "Y'", where the pressurization is made, comes to be 1.5 times larger as the stroke "Y" shown in FIG. 3. Actually, by taking the volume efficiency of the pump into the consideration, the relationship is as below, i.e., (Eq. 1):

$$\eta' \times Y' = \eta \times Y \times 1.5 \quad \text{(Eq. 1)}$$

where, η' and η in the equation are the volume efficiencies per a unitary lift amount of the plunger in FIGS. 3 and 4.

Herein, with using a parameter described in FIG. 4, description will be made about the timing of generating the noises. When the drive signal for the pump is at a certain timing, the pump rod position is shifted after the delay time ΔTp in response, and it collides with the stopper member 93, thereby generating the vibration/noise. Also, when the drive signal is released, then the pump rod is turned back, and it collides with the stopper 94. Although the vibration/noise is also generated when the drive signal for the pump is turned OFF, upon the assumption that the collision caused when the pump is turned ON is larger than that caused when it is OFF, as was mentioned previously, in the present embodiment, attention is paid only onto the vibration/noise is generated when the drive signal is turned ON. Thus, on the basis of the top dead center within the plunger cycle (1) shown in FIG. 4, the pump drive signal is turned ON after passing the time Tp from that basis. Assuming as was mentioned above, the timing when the noise is generated due to the pump driving is at the time after passing the time indicated by (Eq. 2) from the basis.

$$Tp+\Delta Tp \quad \text{(Eq. 2)}$$

A similar consideration is made about the injectors. In the case of the injector, as was mentioned previously, since the vibration/noise caused when the drive signal is OFF is larger, attention is paid to the vibration/noise when it is OFF. The timing when the vibration/noise is generated due to the OFF operation by the injector drive signal is at the timing when the injection valve shifts the position thereof, after passing the delay time ΔTi, from the time when the injector drive signal is turned OFF. Upon the basis of the top dead center within the plunger cycle (1), assuming that the time is "Ti" up to when the injector drive signal is turned ON and the length is "P" of the injector drive signal, the timing when the noise is generated due to the injector driving is at the time after passing the time indicated by (Eq. 3) from the basis is:

$$Ti+P+\Delta Ti \quad \text{(Eq. 3)}$$

Accordingly, the time difference "ϵ" in the timing is as indicated by (Eq. 4), between the noise caused due to the pump and the noise caused due to the injector:

$$\epsilon = |(Ti+P+\Delta Ti)-(Tp+\Delta Tp)| \quad \text{(Eq. 4)}$$

If the time difference "ϵ" is very small, the noises overlap or duplicate each other, so that the noises are loud, in particular, for human hearing. Within the plunger cycle (3) shown in FIG. 4, the time difference "E" is very small, and then the sound pressure of noises is increased. For the purpose of avoiding this, in the embodiment shown in FIG. 3, the control is applied such that the flow rate is increased to be 1.5 times larger within the plunger cycles (1) and (2) while giving no pump drive signal within the plunger cycle (3). By doing this, it is possible to avoid noises overlapping each other, as can be seen in FIG. 4.

Determination can be made on the overlapping or duplication of noises, by deforming the (Eq. 4), in case when:

$$|(Ti+P+\Delta Ti)-(Tp+\Delta Tp)| \leqq \epsilon \quad \text{(Eq. 5)}$$

The very small time "ϵ" is a time within from zero (0) to 0.1 ms, approximately, but it should not be limited only to that. Also, this may be obtained by the following (Eq. 6), for example:

$$\epsilon = n/f \quad \text{(Eq. 6)}$$

where frequency of the sound pressure is "f", and the number of times of vibrations is "n", being necessary for attenuation of the sound pressure.

For example, if the frequency of the sound pressure is 30 kHz, and the number of times of vibrations is three (3), up to the time when the sound pressure is almost attenuated; then ϵ=0.1 ms.

Since the drive signals for the pump and the injector are already given, then ΔTp and ΔTi can be estimated in advance, to be a time up to the time when the noise is generated.

Figure 5:
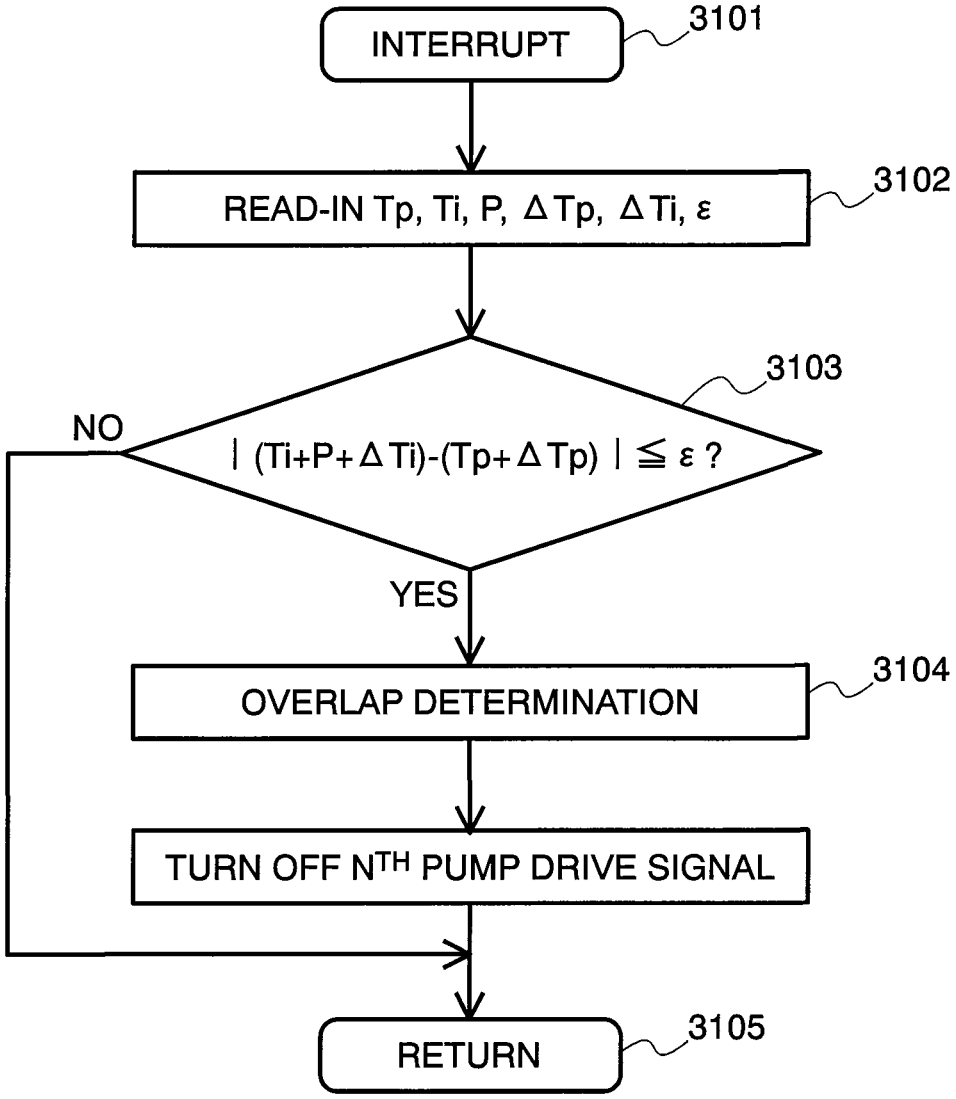
FIG. 5 shows a flowchart for determination of a timing determination circuit, according to an embodiment of the present invention.

FIG. 5 is a flowchart of a timing determination process, for the controller 57 to determine the overlapping or duplication of noises. In a step 3101, an interruption process is made in synchronism with a certain time, such as, every 10 ms, for example. However, the interruption process may be made in synchronism with rotation of the crank angle, such as, every 180° thereof, for example. In a step 3102, the controller reads therein the timing "Tp" when the pump drive signal is provided from a reference position, the timing "Ti" when the injector drive signal is provided from the reference position, the length "P" of the injector drive signal, the response delay time "ΔTp" of pump noise, the response delay time "ΔTi" of injector noise, and the time difference "ϵ" in timing between those noises generations. The timing "Ti" when the injector drive signal is provided and the length "P" of the injector drive signal are calculated to appropriate values, depending on the operation condition of the engine and an instruction given from a driver (i.e., an acceleration opening, etc.). Also, the timing "Tp" when the pump drive signal is given is determined depending on a flow rate required for the pump. The instruction values Tp, Ti, and P are determined through a predetermined calculation and/or by referring to a map, with obtaining the parameters, such as, the engine rotation speed, the acceleration opening, a drive voltage, the common rail pressure, and a vehicle velocity, etc. Also, the delay times "ΔTp" and "ΔTi" and/or the time difference "ϵ" can be determined to be values obtainable by referring to a map, in the similar manner. The delay times "ΔTp" and/or "ΔTi" can be measured in advance, and therefore it/they can be given in the form of a fixed value, or a value obtainable by referring to a map.

Next, in a step 3103, a distance between the noises (|(Ti+P+ΔTi)−(Tp+ΔTp)|) is compared with the very small time "ϵ", to be smaller than that or not. In case when an answer is "YES", it is determined that the noises overlap or duplicate each other, but when it is "NO", it is determined that they do not overlap. In case where the pump is driven by plural numbers of times up to the next interruption timing, Tp and Ti may be obtained and/or calculated, in relation to the drive signals of the pump and the injectors, for the plural numbers of times thereof. If determination is made on the overlapping or duplication in the flowchart mentioned above, then the drive signal is not given or provided at that timing. By doing this, overlapping or duplication of noises is avoided with certainty; thereby reducing engine noises.

The control method according to the present invention is effective when the engine operates under a low load, and further when the engine operates at a low rotation speed, in particular, in the vicinity of the idling rotation speed. In general, the engine noises have a tendency of being small when engine rotation speed is low. By avoiding the noises of the pump and the injectors from overlaying or duplicating with each other, even in such the condition, it is further possible to reduce the noises much more. As an effect obtainable by applying the present invention to the engine when it operates under the low load and the low speed, it is possible to reduce the noises when the engine operates at low rotation speed while maintaining a high output when it operates at high rotation speed.

An aspect of the present invention lies in reduction of the noises within human hearing range, while avoiding the noises, which are generated accompanying with driving of the pump and the injectors, from overlapping or duplicating each other. As an exemplary way of achieving that, according to the present embodiment, stopping or pausing the plunger within the specific one (1) cycle among the three (3) cycle of the plunger cycles has been disclosed; however the overlapping or duplication of noises may be also avoided by stopping or pausing thereof during the specific two (2) cycles. Or, in case where the pump can discharge the fuel, two (2) times per one (1) cycle of the engine at the maximum, then it may be paused one (1) time thereof.

Also, as is shown by the reference numeral 9105 in FIG. 2, as a way of stopping or pausing the pump, there is also a method of giving or providing the drive signal, but only a short one, i.e., not sufficient for driving thereof.

Also, within a fuel supply system, in which the controller 57 provides the feedback control of a value of the pressure sensor 56, since automatic compensation can be made upon the lowering in the flow rate with respect to stoppage or pause of the pump, the present invention can be easily applied therein.

Embodiment 2

Figure 6:
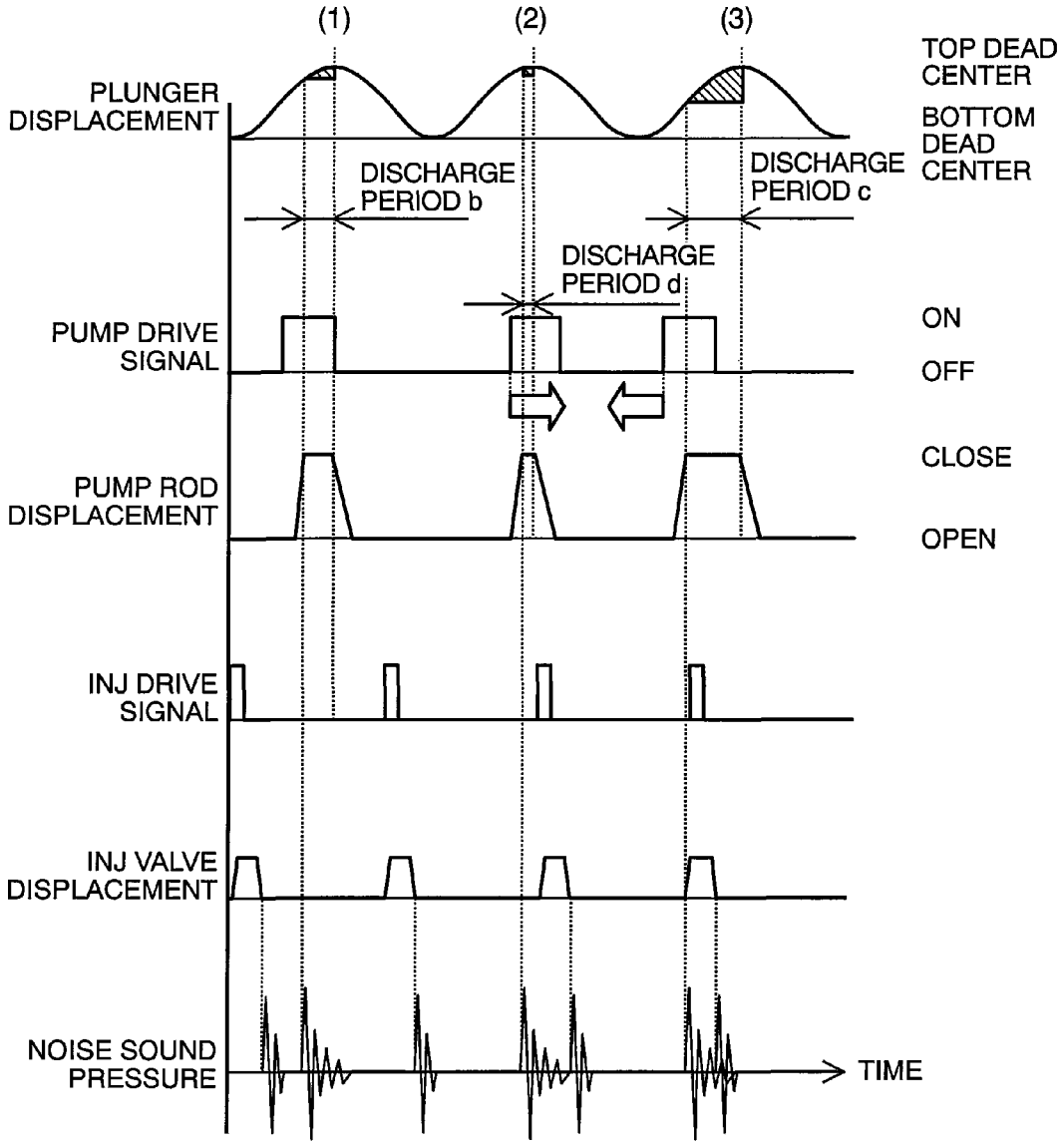
FIG. 6 shows an operation-timing chart of a fuel pump and an injector, according to other embodiment of the present invention.

FIG. 6 shows a timing chart according to other embodiment of the present invention. The structures of the fuel supply system are similar to those of the system shown in FIG. 1.

For avoiding the noises of the pump and the injectors from overlapping on each other within the plunger cycle (3), the timing is moved forward when supplying the pump drive signal. With the pump building up, the flow rate is increased, being discharged from, when the drive timing thereof is moved forward. Accordingly, if only forward moving is made on the timing when the pump drive signal is provided for avoiding the overlapping of the noises, then the pump discharges the fuel much more than that of the desired discharge flow rate, thereby bringing about an increase of the fuel pressure within the common rail 53.

However, if reducing the flow rate discharged by shifting the timing of providing the pump drive signal backward, within the plunger cycles (1) or (2), so as to cancel the fuel discharged too much within the plunger cycle (3), then it is possible to discharge the desired amount of fuel, as the total fuel supply amount for one (1) cycle of the engine. Within one (1) cycle of the engine, there are fluctuations in the amount of fuel discharged by the pump; however since the common rail 53 accumulates the fuel pressure therein, the injectors 54 can inject the fuel under the condition of releasing from or reducing the fluctuation in pressure thereof.

In this manner, through shifting the timing of providing the pump drive signal within one (1) engine cycle, it is possible to avoid the noises from overlapping or duplicating each other, and further it is possible to control the total amount of fuel supply within the engine cycle at the desired value thereof. In this control mode, there can be observed a phenomenon, such as, the distance between drive signals for the pump becoming unequal, or a large difference in magnitude of an increase of pressure, per one (1) cycle of the transferring of the fuel under pressure by means of the pump, etc.

Embodiment 3

Figure 7:
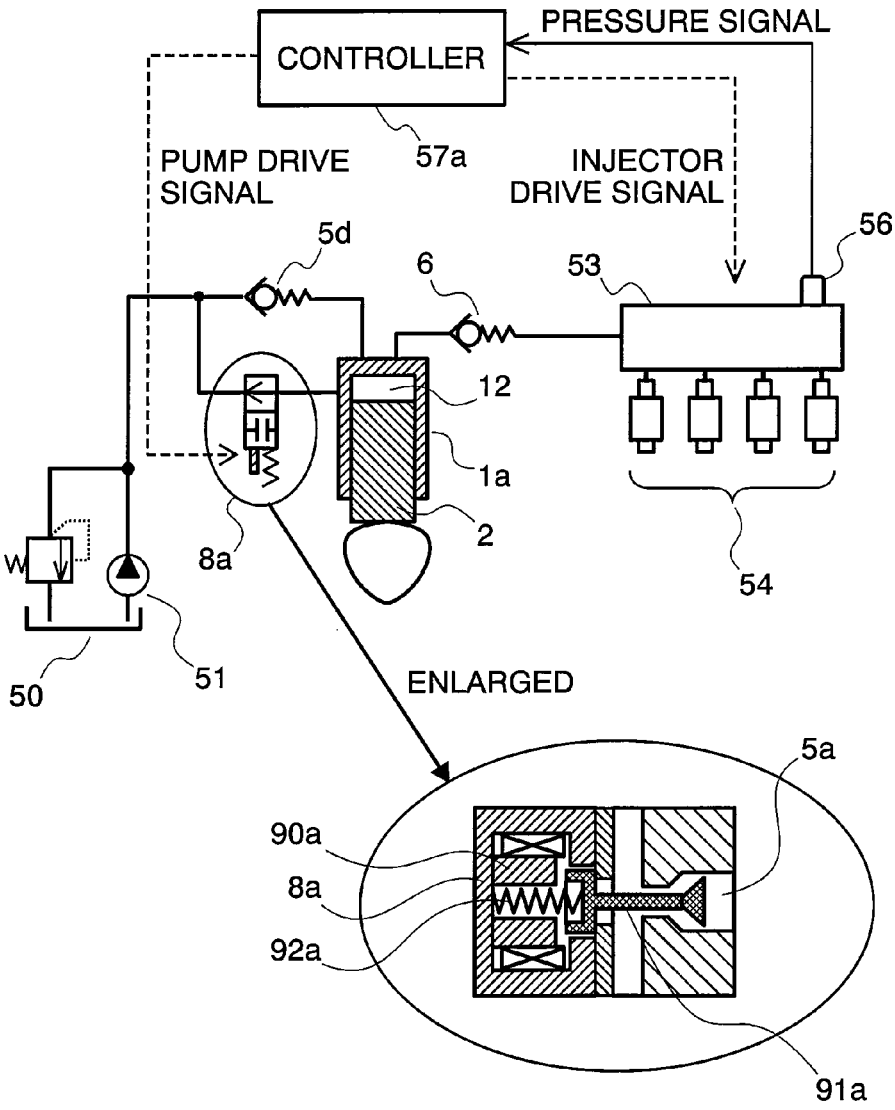
FIG. 7 shows an example of the fuel supply system of another embodiment of the present invention.

FIG. 7 shows a view of other embodiment.

A fuel pump 1*a* repeats the suction/discharge of fuel by reciprocating movement of a plunger 2*a*, and also controls a flow-amount control mechanism 8*a*, thereby controlling an amount of fuel to be discharged to a high-pressure side. The flow-amount control mechanism 8*a* is built up with a suction valve 5*a* and a rod 91*a*, in one body, and is biased into a direction to open the valve by way of a spring 92*a*. When no drive signal is provided to the flow-amount control mechanism 8*a*, the suction valve 5*a* is held closing the valve, through the biasing force of the spring 92*a*; therefore, the fuel pump 1*a* does not pressurize the fuel therein. When the drive signal is provided from the controller 57*a*, the suction valve 5*a* is biased towards the closing position of valve through magnetic sucking force, then it pressurizes the fuel within a pump chamber 12*a*.

The control method for the system of FIG. 7 is similar to that for the above-mentioned system shown in FIGS. 1 and 2; in particular, a flow rate discharged from the pump can be changed by shifting the timing of providing the pump drive signal during the process of pressurizing of fuel. Accordingly, it is possible to apply such the control method therein, as was shown in the embodiment mentioned above.

As a detailed embodiment thereof, description will be give on an example of applying the control method shown as the embodiment 1, by referring to FIG. 3.

"Plunger Displacement" in FIG. 3 shows the change of position of the plunger 2*a*. "Drive Signal of Pump" is a drive signal, which is provided from the controller 57*a* to the flow-amount control mechanism 8*a*, and "Displacement of Pump Rod" indicates the position changes of the rod 91*a* and the suction valve 5*a*. Herein, the suction valve 5*a* is held at the valve opening position through the biasing force of the spring 92*a* when no drive signal is provided thereto, while it is biased to the valve closing position through the magnetism generated by a solenoid 90*a*, when the drive signal is provided thereto.

"INJ (Injector) Drive Signals" are the drive signals to be given to injectors 54*a*, in a similar manner to that of the embodiment mentioned above, and "INJ Valve Displacement" is the change in the position of that valve. "Pump Drive Signal" is given at the timing that is calculated by the controller 57*a*, and the rod 91*a* and the suction valve 5*a* positions are changed, as shown by "Pump Rod Displacement". The suction valve 5*a* is biased and held at the valve opening position by the spring 92*a* under the non-conductive condition thereof, while it is held at the valve closing position through the magnetism generated by the solenoid coil 90*a* under the conductive condition thereof.

When the suction valve 5*a* is closed at certain timing during the pressuring process, the pump starts discharging, and then the pressure within the common rail 53*a* increases. The flow rate discharged from the pump can be controlled; i.e., to be more when the timing of providing the pump drive signal is early, or to be less when it is late. The controller 57*a* controls the timing of providing the pump drive signal, depending upon the fuel supply amount that the injectors 54*a* need.

When the controller 57*a* turns the pump drive signal ON/OFF, the rod 91*a* and the suction valve 5*a* positions change, and each of them collides with the stopper 93 or 94 at a terminal end of the stroke thereof; therefore there is a possibility of generating the vibration and/or noise. In a similar manner, with the injectors 54*a*, as was mentioned previously, there is also a case where the vibration and/or noise is/are generated upon the basis of operation of the injector when turning the drive signal thereof ON/OFF. The magnitude of the vibration/noise is not always the same when turning the signal ON/OFF. For example, since the rod 91*a* is operated through the electric-magnetic force when being ON while it is operated by the spring 92*a* when being OFF, therefore there is a possibility that the collision energy differs in the magnitude thereof, respectively.

Also, with the injector, since the injection valve is operated to be oven through the electro-magnetic force when being ON, while it is operated to close with an aid of the spring force, as well as, the fuel pressure, when being OFF, therefore there is also a possibility that the collision energy differs in the magnitude thereof, respectively. An object of the present invention is to achieve control so that overlapping or duplicating will not made on the energies having large vibration/noise level, in the timing thereof.

For example, in case where the vibrations/noises are large, caused due to ON operation of the pump and due to ON operation of the injector, it is necessary to control the timing of those so that they do not overlap or duplicate each other. Or, in case where the vibrations/noises are large, caused due to OFF operation of the pump and due to OFF operation of the injector, it is also necessary to control their timing so that they do not overlap or duplicate each other.

Also in the present embodiment, it is assumed that the vibration/noise caused due to ON operation of the pump and the vibration/noise caused due to OFF operation of the injector are large, description will be made on the method for avoiding those from overlapping with each other.

In the control method according to the present embodiment, the controller 57*a* thins the pump drive signals, i.e., cutting out one (1) from three (3) pieces or times of generations thereof, periodically. Within the plunger cycles (1) and (2) where the pump is driven without conducting the thinning of the drive signals, the noises caused due to the driving of pump is generated, but not overlapping or duplicating the noises caused due to the driving of injectors. On the other hand, during the plunger cycle (3) where the pump drive signal is thinned or cut out, of course, no operating sound is generated due to the change of position of the pump rod. For this reason, within the plunger cycle (3), the pump noise never overlaps with the injector noise.

In the present embodiment, the cycle(s) is/are specified in advance within which the overlapping or duplication could be seen to occur, and then the drive signal is omitted therein. Further, the number of times of injections by the pump is reduced, and in addition thereof, the discharge flow rate by one (1) cycle of the pump is increased, thereby maintaining the total flow rate per one (1) cycle of the engine.

Embodiment 4

Figure 8:
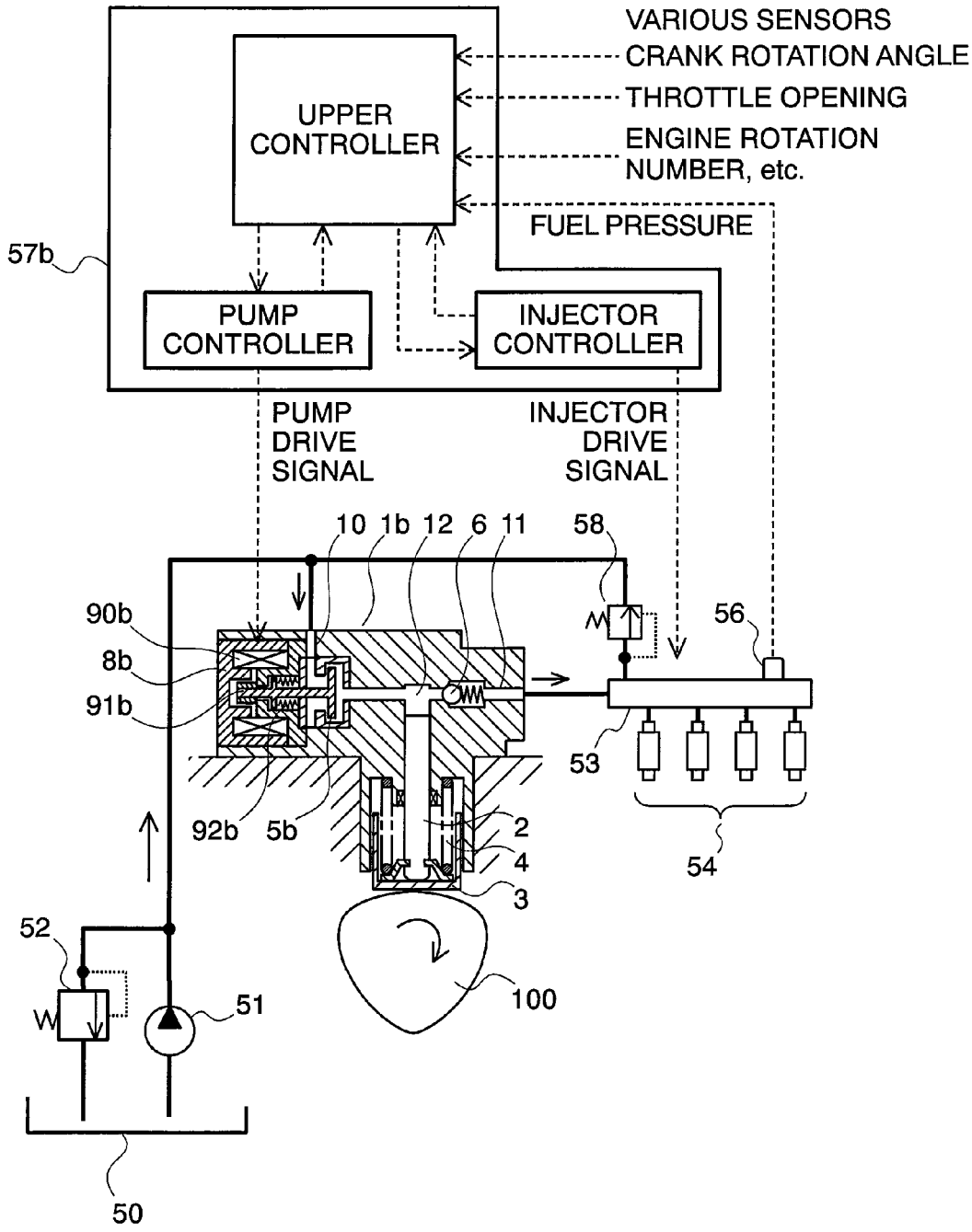
FIG. 8 also shows an example of the fuel supply system of a further embodiment of the present invention.

FIG. 8 shows a view of further embodiment.

A flow-rate control mechanism 8*b* has a suction valve 5*b* and a rod 91*b* in one body, and a spring 92*b* biases the suction valve 5*b* into a closing direction. Also, the rod 91*b* and the suction valve 5*b* are biased into the opening direction through magnetic attracting force when conducting current through a solenoid coil 90*b*. In the just-described flow-rate control mechanism 9*b*, in the case when the controller 57*b* issues no drive signal to the pump during the fuel pressurizing process, the suction valve 5*b* is kept closed with an aid of the biasing force of the spring 92*b*; therefore, the fuel pump 1*b* can pressurize the fuel therein. Also, when the controller 57*b* issues the drive signal to the pump during the pressurizing process, the suction valve 5*b* is biased into the opening position thereof through the magnetic attracting force; therefore, the fuel pump 1*b* cannot pressurize the fuel therein. Within the fuel supply system comprising the above-described flow-rate control mechanism 8*b*, the flow rate discharged therefrom is controlled by chaining the timing of cutting off the drive signal for the pump.

Figure 9:
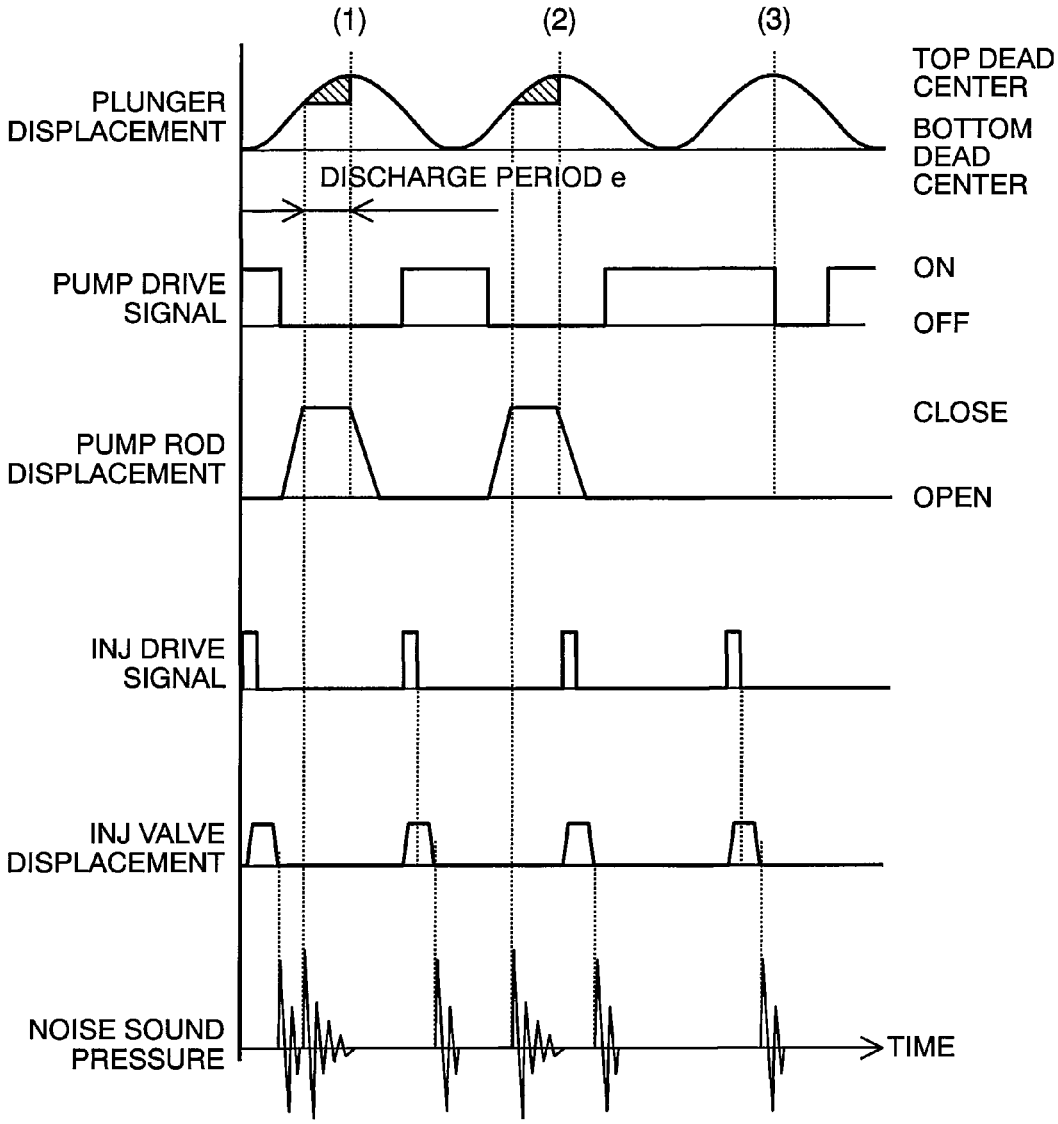
FIG. 9 shows an operation-timing chart of a fuel pump and an injector, within the fuel supply system shown in FIG. 8.

FIG. 9 shows the timing charts of drive signals within the system having the foregoing structure.

In the direction into which the position of the rod 91*b* is shifted, it is indicated by "Close" when the pump drive signal is turned OFF, while it is "Open" when the pump drive signal is turned ON. The suction valve 5*b* is opened during the suction process, and the rod 91*b* and the suction valve 5*b* are kept at the closing positions thereof through the electro-magnetic force, with provision of the pump drive signal given by the controller during that suction process. When the pump drive signal is released at the timing, as calculated by the controller 57*b*, the rod 91*b* and the suction valve 5*b* shift into the closing positions thereof; therefore, the fuel is pressurized within the pump chamber 12*b*, so as to start the transfer thereof under pressure. In this manner, by changing the timing of cutting off the pump drive signal during the pressurizing process, control of the flow rate discharged from the pump is effected. Noises are generated at the timing when the rod 91*b* and the suction valve 5*b* shift the positions thereof, after the ON/OFF operations thereof by the drive signals.

In the present embodiment, explanation will be made hereinafter, upon the assumption that the noise generated when the drive signal is turned OFF is larger than that when it is ON.

The graph shows in the lowest stage thereof main noises caused due to operations of the pump/injectors in the form of waveforms of the sound pressure thereof. The controller 57*b* thins or cut out the pump drive signals, i.e., one (1) time for three (3) times thereof, periodically. In more detail, during the period up to when completing the pressurizing process within the plunger cycle (3), the drive signals are kept to given, thereby keeping the pump rod into the closing position thereof. In doing this, the rod 91*b* does not shift its position within the plunger cycle (3), nor generate the noise due to driving of the pump; therefore, it is possible to avoid the injector noise and the pump noise from overlapping or duplicating each other. On the other hand, since no fuel is injected during the plunger cycle (3), then the discharge flow rate is increased by effecting the OFF timing earlier within the other plunger cycles (1) and (2). By doing so, the fuel pump is able to supply the fuel with a balanced amount of fuel injection by the injectors, and therefore it is possible to obtain the control of maintaining the pressure within a common rail 53*b* to be nearly constant, based on the time-average thereof.

As the condition for applying the control method according to the present invention therein, a parameter, such as, the engine rotation speed of the engine load, for example, can be used. Namely, as a condition for exercising the present control method, it is detected that the engine operates under the condition of being less than a specific rotation speed or of the engine load. For example, if reducing the operation frequency of the variable capacity fuel pump (i.e., the number of times of discharging), an amount of discharge is lowered. Even if trying to compensate the lowering of the fuel by increasing the discharge amount before and after thereof, since the fuel amount to be consumed may be greater within a region or wherein the engine rotation is high, therefore sometimes the compensation may not be sufficient enough thereof. Then, it is preferable to execute the control so as to reduce the number of times of operating the variable capacity fuel pump (i.e., the number of times of discharging) within the idling operation thereof, while not executes this control within a region where the engine rotation speed is higher than that of the idling operation.

Also, at the timing when exchanging between a normal control mode and the control method of the present invention occurs, it is further preferable to increase/decrease the instruction value on the flow rate of the pump, since it can stabilize the pressure within the common rail before and after the timing of exchange between them.

As can be fully understood from the above explanation, the control apparatus for the fuel supply system is able to reduce the audible engine noises and avoiding the noises caused due to driving of the injectors and the noises caused due to driving of the pump from overlapping or duplicating each other by thinning the drive signals for the pump or shifting their timing. Further, the pump is able to supply the necessary fuel to the injectors thereby enabling the internal combustion engine to be maintained at a desired operating condition thereof.

The present invention may be embodied in other specific forms without departing from the spirit or essential feature or characteristics thereof. The present embodiment(s) is/are therefore to be considered in all respects as illustrative and not restrictive, the scope of the invention being indicated by the appended claims rather than by the forgoing description and range of equivalency of the claims are therefore to be embraces therein.

What is claimed is:

1. A high pressure fuel supply pump for supplying high pressure fuel to a fuel injection valve of an internal combustion engine, comprising:

a suction port located at an entrance of a pressurizing chamber;

a rod magnetically driven by conducting current through an electromagnetic coil;

a suction valve for opening/closing a valve seat, the suction valve being located at the pressurizing chamber side of said suction port;

a controller receiving input from various sensors and controlling suction valve opening and closing; and a spring for biasing said suction valve in an opening direction or a closing direction, wherein said rod is arranged to maintain said suction valve in an open condition or a closed condition while current conduction occurs through said electromagnetic coil and to move said suction valve in a direction away from said open condition or said closed condition after stopping current conduction through said electromagnetic coil, said rod or said suction valve is configured such that an operation stroke thereof is restricted by a stopper provided at an end of the operation stroke, and said suction valve is maintained in the open condition when the controller estimates based on the input received that a closing timing of the fuel injection valve and actuation a closing timing of the suction valve will occur simultaneously.

2. The high pressure fuel supply pump as described in claim 1, wherein said rod and said suction valve are configured as another member, and said spring includes a first spring by which said rod is biased into a suction valve side, and a second spring by which said suction valve is biased into a valve seat side.

3. The high pressure fuel supply pump as described in claim 1, wherein said rod and said suction valve are configured as one body, and said spring is arranged to bias said rod in a direction so that said suction valve is pushed to said valve seat.

4. The controller of a high pressure fuel supply pump as described in claim 1, wherein a drive signal of said electromagnetic coil is controlled to maintain said suction valve in an opening the open condition at a fuel injection valve closing timing under a low-speed engine operating condition.

5. The controller of a high pressure fuel supply pump as described in claim 4, wherein the fuel injection valve closing timing overlaps a fuel suction valve closing timing under the low-speed engine operating condition.

* * * * *